US005784032A

United States Patent [19]

Johnston et al.

[11] Patent Number: 5,784,032

[45] Date of Patent: Jul. 21, 1998

[54] COMPACT DIVERSITY ANTENNA WITH WEAK BACK NEAR FIELDS

[75] Inventors: Ronald H. Johnston, Calgary; Laurent Joseph Levesque, Winnipeg, both of Canada

[73] Assignee: Telecommunications Research Laboratories, Edmonton, Canada

[21] Appl. No.: 551,547

[22] Filed: Nov. 1, 1995

[51] Int. Cl.[6] ..... H01Q 1/24

[52] U.S. Cl. ..... 343/702; 343/742; 343/846

[58] Field of Search ..... 343/702, 700 MS, 343/741, 742, 846, 848, 841, 725, 727, 729, 789, 797, 866

[56] References Cited

U.S. PATENT DOCUMENTS

| | | | |
|---|---|---|---|
| 2,897,496 | 7/1959 | Woodward, Jr. | 343/818 |
| 3,036,301 | 5/1962 | Wiesner | 343/100 |
| 3,172,111 | 3/1965 | Breetz | 343/730 |
| 3,475,756 | 10/1969 | Martino | 343/743 |
| 4,217,591 | 8/1980 | Czerwinski | 343/713 |
| 4,611,212 | 9/1986 | Lee | 343/351 |
| 4,684,953 | 8/1987 | Hall | 343/725 |
| 5,075,820 | 12/1991 | Juskey et al. | 343/700 MS |

(List continued on next page.)

FOREIGN PATENT DOCUMENTS

| | | | |
|---|---|---|---|
| 1201200 | 2/1986 | Canada | 351/60 |
| 2278500 | 11/1994 | United Kingdom | 343/794 |

OTHER PUBLICATIONS

Fundamentals of Diversity Systems, W.C. Jakes, Y.S. Yeh, M.J. Gans, and D.O. Reudink, Microwave Mobile Communications, IEEE Press, pp. 309–329, 1994.

Combining Technology, Lee, W.C.Y., Mobile Communications Engineering, McGraw–Hill, pp. 291–318, 1982.

Energy Reception for Mobile Radio, by E.N. Gilbert, BSTJ, vol. 44, pp. 1779–1803, Oct., 1965.

Effects of System RF Design on Propogation, Lee, W.C.Y., Mobile Communications Engineering, McGraw–Hill, pp. 159–163.

A Comparison of Switched Pattern Diversity Antennas, Tim Aubrey and Peter White, Proc. 43rd IEEE Vehicular Technology Conference, pp. 89–92, 1993.

A Survey of Diversity Antennas for Mobile and Handheld Radio, Johnson, R.H., Proc. Wireless 93 Conference, Calgary, Alberta, Canada, pp. 307–318, Jul., 1993.

A Flat Energy Density Antenna System for Mobile Telephone, Hiroyuki Arai, Hideki Iwashita, Nasahiro Toki, and Naohisa Goto, IEEE Transactions on Vehicular Technologies, vol. VT40, No. 2, pp. 483–486, May 1991.

A Multiport Patch Antenna For Mobile Communications, R.G. Vaughan and J.B. Andersen, Proc. 14th European Microwave Conference, pp. 607–612, Sep. 1984.

Small Antennas, Harold A Wheeler, IEEE Transactions on Antennas and Propagation, vol. AP–23, No. 4, pp. 462–469 (Fig. 12), Jul. 1975.

Radiowave Propagation and Antennas for Personal Communications, Siwiak, K. pp. 228–245, Artech House, 1995.

EM Interaction of Handset Antennas and a Human in Personal Communications, Michael A. Jensen, Yahya Rahmat–Samii, Proc. IEEE, vol. 83, No. 1, pp. 7–17, Jan., 1995.

*Primary Examiner*—Donald T. Hajec
*Assistant Examiner*—Tan Ho
*Attorney, Agent, or Firm*—Anthony R. Lambert

[57] ABSTRACT

A compact diversity antenna is presented consisting of two electrically isolated orthogonal loop conductors joined at a midpoint. This midpoint is also electrically attached to a vertical conductor which produces a third mode of operation electrically isolated from the first modes. The two horizontal conductors and the vertical conductor may be constructed to have various relationships with a ground plane of various shapes and sizes. Some of the possible feed arrangements for each of the antennas is presented as well as matching and tuning circuits. All three antenna elements are found to have relatively weak near electric and magnetic fields on the ground plane side of the antenna where the ground plane is small in extent. This feature provides for reduced radiation into the head and neck of the cellular phone user.

65 Claims, 13 Drawing Sheets

U.S. PATENT DOCUMENTS

| | | | |
|---|---|---|---|
| 5,146,232 | 9/1992 | Nishikawa | 343/713 |
| 5,173,715 | 12/1992 | Rodal et al. | 343/797 |
| 5,185,611 | 2/1993 | Bitter, Jr. | 343/702 |
| 5,231,407 | 7/1993 | McGirr et al. | 343/702 |
| 5,291,210 | 3/1994 | Nakase | 343/700 MS |
| 5,325,403 | 6/1994 | Siwiak et al. | 375/100 |
| 5,338,896 | 8/1994 | Danforth | 343/841 |
| 5,392,054 | 2/1995 | Bottomley et al. | 343/702 |
| 5,521,610 | 5/1996 | Rodal | 343/797 |

COMPACT DIVERSITY ANTENNA WITH WEAK BACK NEAR FIELDS

FIELD OF THE INVENTION

This invention relates to diversity antennas that can simultaneously receive or transmit two or three components of electromagnetic energy.

BACKGROUND OF THE INVENTION

Antenna diversity is especially useful for improving radio communication in a multipath fading environment. Sporadic deep fades occur (especially in an urban or inbuilding environment) on a radio channel leading to signal loss. Without diversity, power levels must be maintained sufficiently high to overcome these deep fades. Antenna diversity may be used to produce low correlation radio channels which produce signal amplitudes that are statistically independent. The probability of simultaneous deep fades on uncorrelated channels is relatively low. When a deep signal fade occurs on one channel, signal degradation or loss can usually be avoided by switching to another channel. Consequently, signal reliability can be improved, and power requirements can be reduced while maintaining signal reliability by using antenna diversity. The improvements in signal strength with various diversity antenna combining techniques are quantified by authors such as W. C. Jakes, Editor, Microwave Mobile Communications, IEEE Press, pp. 309–329,1994, and W. C. Y. Lee, Mobile Communications Engineering, McGraw-Hill, pp. 291–318, 1982.

Increasing the number of diversity channels improves signal reliability and lowers the transmitter power requirement. However, as the number of diversity channels is increased, the incremental improvement decreases with each additional diversity channel. For instance, two-way diversity offers a significant improvement over a single channel. Three-way diversity offers a significant improvement over two-way diversity, although the incremental improvement is not as great. At higher diversity levels, i.e., greater than 5, the signal improvement is generally not significant when weighed against the additional complexity of the switching and control circuitry. Three-way diversity can significantly improve signal to noise ratio over two-way diversity, but neither are widely used, largely, it is believed, due to a lack of antennas with suitable compactness, bandwidth and ruggedness.

There are several types of antenna diversity. Angle diversity involves the use of elemental antennas with narrow beams that point in slightly different directions. Sufficient angle separation between the elemental antennas produces low correlation channels. Space diversity involves separating antennas by a sufficient distance (horizontally or vertically) to produce low correlation channels. These two methods have the disadvantage of requiring separate antennas and are generally not physically compact.

Polarization diversity involves having elemental antennas for independently receiving separate polarizations of the electromagnetic wave. Channels may exhibit sensitivity to the polarization of the transmitted electromagnetic wave.

E. N. Gilbert, "Energy Reception for Mobile Radio", BSTJ, vol. 44, pp. 1779–1803, October 1965, and W. C. Y. Lee, Mobile Communications Engineering, McGraw-Hill, pp. 159–163, 1982 have proposed a field diversity antenna where three individual antennas are sensitive to Hx, Hy and Ez field which are all vertically polarized. Pattern diversity uses broad radiation patterns of elemental antennas to receive or transmit into wide angles but each elemental antenna has a different arrangement of nulls to suppress multipath fading effects. Pattern, polarization and field diversity methods are probably the most promising for producing compact diversity antennas. T. Auberey and P. White, "A comparison of switched pattern diversity antennas", Proc. 43rd IEEE Vehicular Technology Conference, pp. 89–92, 1993, have shown that the Hx, Hy and Ez field diversity antenna has very similar performance to the three way pattern diversity with patterns of sin $\phi$, cos $\phi$ and omni.

It has recently been shown that standard cell phone antennas deposit between 48% and 68% of transmitter output energy into the head and the hand of the user, M. A. Jensen and Y. Rahmat-Samii, "EM Interaction of Handset Antennas and a Human in Personal Communications", Proc. IEEE, Vol. 83, No. 1, pp. 7–17, January, 1995.

This deposition of electromagnetic energy (into the head especially) raises health and legal issues and it also removes EM power from the communications channel. It therefore behooves the antenna designer to find methods for reducing this electromagnetic energy deposition into the head of a cell phone user.

A moderate number of diversity antennas are discussed in the literature as reviewed by R. H. Johnston, "A Survey of Diversity Antennas for Mobile and Handheld Radio", Proc. Wireless 93 Conference, Calgary, Alberta, Canada, pp. 307–318, July 1993.

Three of the antennas discussed in that paper should be considered in relation to the three way diversity antenna being presented here. These are:

The crossed loop antenna of E. N. Gilbert, "Energy Reception for Mobile Radio" BSTJ, vol. 44, pp. 1779–1803, October 1965, and W. C. Y. Lee, Mobile Communications Engineering, McGraw-Hill, pp. 159–163, 1982, responds to the Hx, Hy and Ez radiation fields. The antenna requires three hybrid transformers which introduce circuit complexity and signal power loss and the antenna requires a large ground plane. The issue of antenna efficiency, impedance matching and bandwidth are not effectively addressed.

The slotted disk antenna of A. Hiroyaki, H. Iwashita, N. Taki, and N. Goto, "A Flat Energy Diversity Antenna System for Mobile Telephone", IEEE Transactions on Vehicular Technologies, Vol. VT40, no. 2, pp. 483–486, May 1991, also responds to the Hx, Hy and Ez fields and is an innovative and complete design with a diameter of about 0.6$\lambda$ and a height of about 0.05$\lambda$ and has bandwidths of 10% and 6%. The antenna has an interelemental antenna isolations of 10 dB. This antenna is the smallest antenna presently available but even smaller sized antennas and greater interelemental antenna isolations are required in many cellular radio applications.

The multimode circular patch antenna by R. G. Vaughan and J. B. Anderson, "A Multiport Patch Antenna for Mobile Communications", Proc. 14th European Microwave Conference, pp. 607–612, September 1984, provides approximately a sin $\phi$, cos $\phi$ and omni radiation pattern but the antenna is fairly large and the isolation is only about 10 dB. The antenna is a microstrip patch design which is inherently narrow band for a reasonable dielectric thickness.

H. A. Wheeler, in a paper entitled "Small Antennas", IEEE Transactions on Antennas and Propagation", Vol. AP-23, no. 4, pp. 462–469(FIG. 12), July 1975, discusses a structure which has an appearance similar to one of the embodiments seen later in this patent application. It shows an open top shallow square box with cross conductors across the top. Wheeler indicates that this antenna has good bandwidth for its size and it may be operated in two modes. He does not note that this can provide diversity operation and he does not note the possibility of the third vertical elemental antenna which produces another mode of operation.

The standard antennas used on handheld cellular radio telephones are the electric monopole mounted on a conductive box and single and double PIFA (Planar inverted F antennas) and BIFA (Bent inverted F antennas) mounted on conductive boxes. Recent analytical work on these antennas indicate that these various antennas deposit between 48% and 68% of the total output power into the head and the hand of the user, M. A. Jensen and Y. Rahmat-Samii, "EM Interaction of Handset Antennas and a Human in Personal Communications", Proc. IEEE, Vol. 83, No. 1, pp. 7–17, January, 1995.

SUMMARY OF THE INVENTION

In a broad aspect of the invention, there is therefore provided an antenna comprising:

means forming a ground plane;

a first antenna element extending in a loop from a first part of the ground plane to a second part of the ground plane; and a second antenna element extending in a loop from a third part of the ground plane to a fourth part of the ground plane, the second antenna element intersecting the first antenna element at an intersection.

In a further aspect of the invention, a third antenna element forming a conducting monopole having a predominantly Ez field radiation pattern is located at the intersection of the first and second antenna elements.

In a further aspect of the invention, there is provided feed means to feed electric signals to the first and second antenna elements. The feed means is configured to produce a virtual ground at the intersection of the first and second antenna elements, thereby providing isolation of the antenna elements.

In a further aspect of the invention, the feed means provides feed electric signals to the first and second antenna elements at the intersection of the first and second antenna elements.

In a further aspect of the invention, the ground plane forms a box, the box including a peripheral wall depending from the first and second antenna elements and a bottom spaced from the first and second antenna elements and enclosed by the peripheral wall.

In a further aspect of the invention, each antenna element is formed of strips whose width is greater than their thickness.

In a further aspect of the invention, the first and second antenna elements bisect each other.

In a further aspect of the invention, the ground plane is commensurate in size to the first and second antenna elements.

In a further aspect of the invention, each of the first and second antenna elements is curved.

In a further aspect of the invention, each of the first and second antenna elements form part of a spherical shell.

In a further aspect of the invention, the ground plane extends laterally no further than the first and second antenna elements.

In a further aspect of the invention, the first and second antenna elements extend between diagonal corners of the box.

In a further aspect of the invention, the first and second antenna elements are orthogonal to each other.

In a further aspect of the invention, at least each of the first and second antenna elements create a reactance in use and the invention further includes means integral with each of the first and second antenna elements for tuning out the reactance of the respective first and second antenna elements.

In a further aspect of the invention, each means for tuning out the reactance of the first and second antenna elements includes a capacitative element matching the respective one of the first and second antenna elements to a given impedance.

In a further aspect of the invention, the feed means for each antenna element forms a transmission line connected to the respective antenna elements at the intersection of the antenna elements.

In a further aspect of the invention, the feed means includes, for each antenna element, a conducting microstrip capacitatively coupled to the antenna element.

In a further aspect of the invention, the first and second antenna elements are each formed of first and second conducting strips spaced from each at the intersection of the first and second antenna elements; and the conducting microstrip of each antenna element connects to one of the first and second conducting strips and extends along and spaced from the other of the first and second conducting strips.

In a further aspect of the invention, the feed means for each antenna element is a coaxial transmission line in which an outer conductor is continuously connected to a portion of the antenna element.

In a further aspect of the invention, the feed means includes a first feed point on the first antenna element, a second feed point on the second antenna element, a source of electrical energy, and a splitter connected to the source of electrical energy and to the first and second feed points to provide equal anti-phasal currents to the respective first and second feed points.

In a further aspect of the invention, there is provided a mobile phone transceiver comprising a housing, a radio transceiver disposed within the housing, the radiotransceiver including a microphone on one side of the housing; and an antenna having means forming a ground plane with a weak near field on a first side of the antenna, and antenna elements on a second side of the antenna, the antenna being oriented with respect to the housing such that when the microphone is in position close to the mouth of a mobile phone user the first side of the antenna is closer to the head of the user than the second side of the antenna.

These and other aspects of the invention will now be described in more detail and claimed in the claims that follow.

BRIEF DESCRIPTION OF THE DRAWINGS

There will now be described preferred embodiments of the invention, with reference to the drawings, by way of illustration, in which like numerals denote like elements and in which.

DETAILED DESCRIPTION OF PREFERRED EMBODIMENTS

Figure 1:
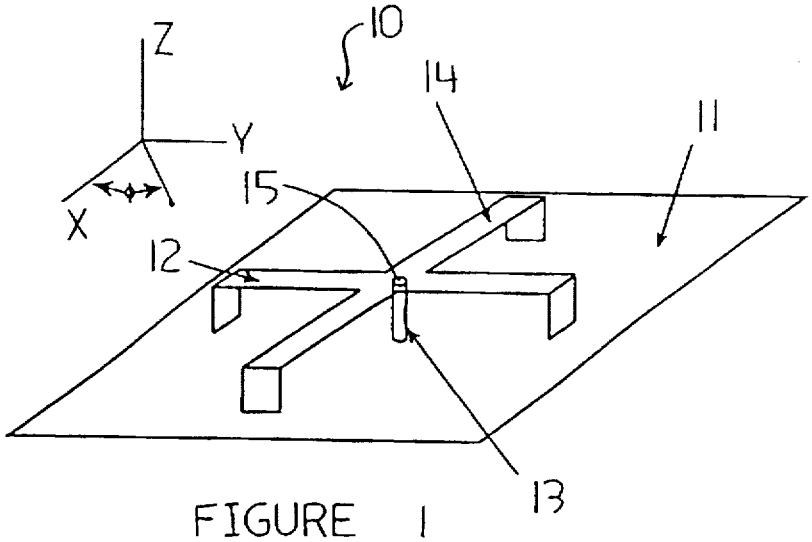
FIG. 1 is a schematic showing arrangement of two magnetic loops and one electric monopole according to an aspect of the invention.

The three-way diversity antenna, as realized by orthogonal horizontal conductors and a vertical conductor, in a compact configuration, has many advantages over other diversity antennas. One embodiment is shown in FIG. 1. The basic shape of the antenna 10 is shown without the elemental antenna feed arrangements, and is formed on a ground plane 11. The ground plane 11, and the other ground planes shown in the figures, is preferably electrically small, namely its length, in the longest dimension, should be less than the wavelength, and preferably less than half the wavelength, for example one-quarter of the wavelength, of the carrier frequency of the transceiver the antenna is to be used with.

The Hx antenna element 12 (aligned in the y direction) extends in a loop from spaced apart locations on the ground plane 11, provides (when a current passes through it, that is, when it is in use) a magnetic field in the x direction (Hx) which produces a vertically polarized EM wave with approximately a sin $\phi$ radiation pattern and provides an electric field in the y direction, which in turn produces a horizontally polarized EM wave with approximately a cos $\phi$ radiation pattern.

The Hy antenna element 14 (aligned in the x direction) also extends in a loop from spaced apart locations on the ground plane 11, and, in use, provides a y directed magnetic field (Hy) which produces a vertically polarized EM wave with an approximate pattern of cos $\phi$ and provides an electric field in the x direction (Ex) which produces a horizontally polarized EM wave with approximately a sin $\phi$ radiation pattern.

This complete angular coverage and polarization coverage makes the antenna very suitable for a cell phone and personal communication phone as the antenna can have a variety of orientations with the user and can have a variety of orientations and polarizations with the base station antenna. The vertical reactively loaded monopole conductor 13 produces an electric field in the z direction ($E_z$) that is approximately omnidirectional and is vertically polarized. The antenna elements 12 and 14 intersect at an intersection 15, and the monopole 13 connects between the intersection 15 and the ground plane 11. When these antennas are fed so as to preserve physical and electrical symmetry each antenna element is highly isolated from the other two antenna elements.

The length of the loop antenna elements should not exceed about $\lambda/2$ and the height of the monopole should not exceed about $\lambda/4$ where $\lambda$ is the wavelength of the carrier frequency the antenna is to be used with. The choice of the actual dimensions is dictated by the end use, and involved a trade off between features well known in the art such as efficiency, bandwidth and return loss.

Good isolation between the antenna elements ensures that antenna elements do not affect each other in terms of their radiation patterns or input impedance or polarization. The outputs from all antenna elements may be directed to separate receivers (not shown) without diminishing the power available from any other antenna element. This allows the antenna elements to be used for switched selective combining, equal gain combining and maximal ratio combining as discussed by W. C. Jakes, Editor, Microwave Mobile Communications, IEEE Press, pp. 309–329, 1994, or W. C. Y. Lee, Mobile Communications Engineering, McGraw-Hill, pp. 291–318, 1982, or any other combining method.

For most cellular radio applications it is desirable to make the antenna as small as possible but still achieve the necessary electrical performance. This antenna can be made very compactly for a given bandwidth and operating frequency.

Figure 2:
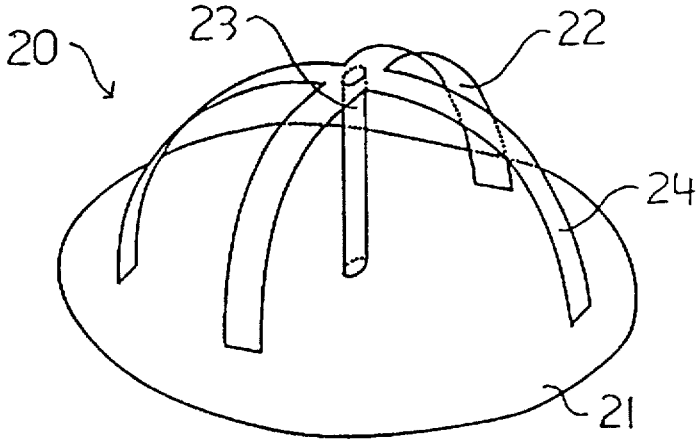
FIG. 2 is a schematic showing an embodiment of loop conductors lying on the surface of a spherical shell according to an aspect of the invention.
Figure 3:
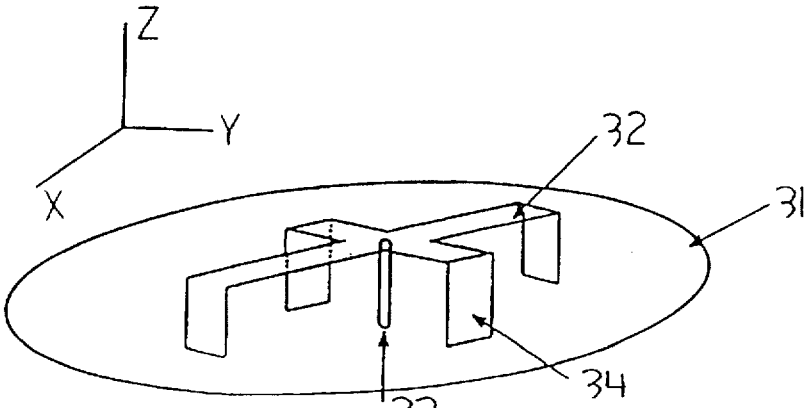
FIG. 3 is a schematic showing a rectangular conductor top view embodiment according to an aspect of the invention.

Another possible conductor arrangement is shown in FIG. 2 in which an antenna 20 is formed from a round ground plane 21, intersecting loop antenna elements 22 and 24 forming part of a spherical shell, and monopole 23. Each of the antenna elements and the ground plane function in much the same manner as the configuration of FIG. 1. While the configuration of FIG. 2 provides improved bandwidth using curved antenna elements, the configuration of FIG. 1 is easier to make. It is preferred that the antenna elements bisect each other as shown in FIGS. 1, 2 and 3, and that the antenna elements be orthogonal to each other as shown in FIGS. 1, 2 and 3. However, the antenna elements do not need to be equal in length. As shown in FIG. 3, one antenna element 32 may be shorter than the other antenna element 34, such that the antenna elements 32 and 34 have different height to width aspect ratios.

In addition to the variations in the shape of the H antenna element profiles, the antenna elements 12, 13, 14, 22, 23 and 24 etc may also have different cross-sectional shapes as well as widths along the length of the conductor. The cross section of the magnetic loops and the monopole conductor may be round, elliptical, flat or a cross made out of flat conductors. These conductors may also be tapered along their length as shown in FIGS. 25–28. This might be useful where the physical strength of the antenna could be important in exposed environments. Varying the cross section of the conductors may be used to vary the bandwidth and input impedance of the antenna.

Figure 4:
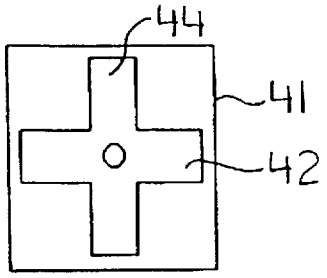
FIG. 4 is a schematic showing a square ground plane according to an aspect of the invention.
Figure 5:
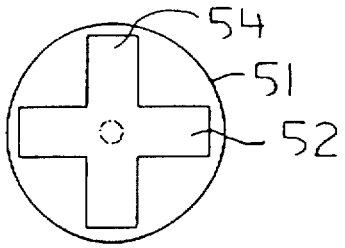
FIG. 5 is a schematic showing a round ground plane according to an aspect of the invention.
Figure 6:
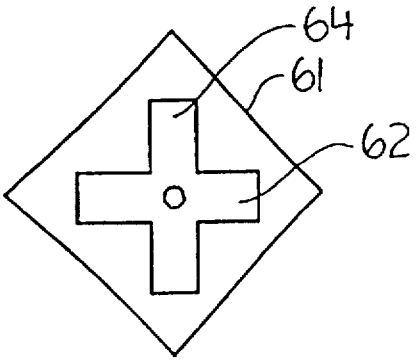
FIG. 6 is a schematic showing a diamond shaped ground plane according to an aspect of the invention.
Figure 7:
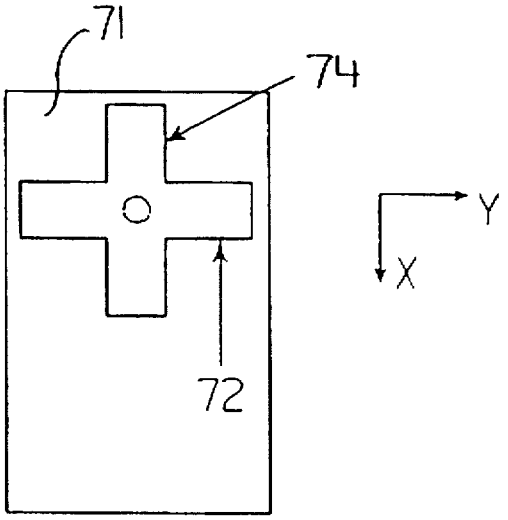
FIG. 7 is a schematic showing a non-symmetrical rectangular ground plane according to an aspect of the invention.

Various placements of the antenna elements to the ground plane may be used. The simplest conceptual arrangement consists of the conductors being placed on an infinite ground plane, or a ground plane that is very large in relation to the size of the antenna elements. Possible ground planes include the square ground plane 41 of FIG. 4, round ground plane of FIG. 5, diamond ground plane of FIG. 6 and rectangular ground plane of FIG. 7. An elliptical ground plane as shown in FIG. 3 may also be used.

The antenna elements 42, 44, 52, 54, 62, 64, 72 and 74 of FIGS. 4–7 are preferably symmetrically placed on a symmetrical ground plane to ensure that high isolation between the radiating elements will be maintained. The non-symmetrical arrangement shown in FIG. 7 will cause a degradation of the isolation between Hx magnetic loop and the $E_z$ radiating element monopole. The high isolation between the Hx and the Hy antenna element feed points will be maintained.

Figure 8:
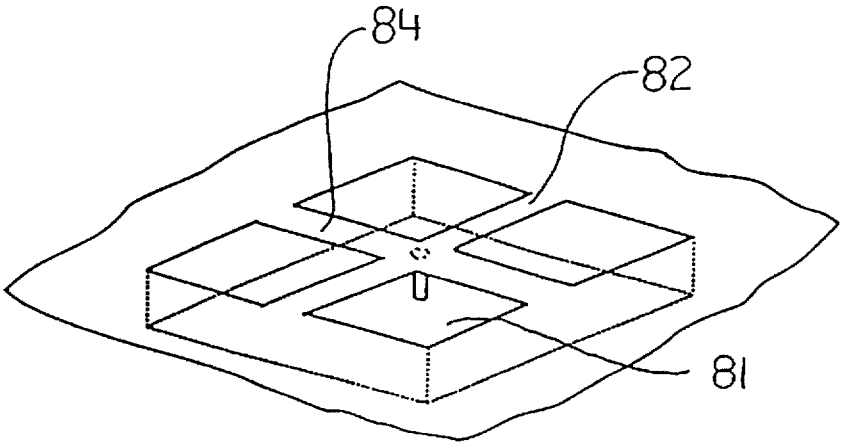
FIG. 8 is a schematic showing an embodiment using a local sunken ground plane according to an aspect of the invention.
Figure 9:
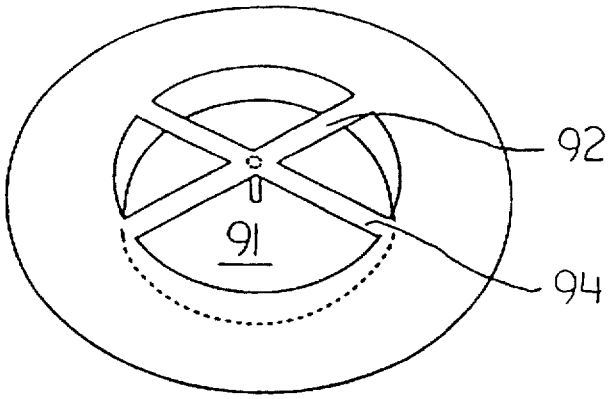
FIG. 9 is a schematic showing an embodiment of a cylinder local sunken ground plane according to an aspect of the invention.

The relationship between the ground plane and the radiating elements can also be changed in the side cross sectional view of the antenna. In fact, the concept of the ground plane can be significantly altered. FIG. 8 shows an embodiment that uses a local sunken ground plane 81 forming a box in which antenna elements 82 and 84 span across the top of the ground plane 81. The sunken ground plane may have plan views other than square configurations. These may also be round as shown in FIG. 9, diamond, elliptical and rectangular.

A vertical, cross-sectional view of the cavity below the Hx and Hy antenna elements may take the shape of a square, a circle, a rectangle or an ellipsoid, or other largely arbitrary but symmetrical shape. The normal cross-sectional vertical view may be different from the top view.

Figure 10:
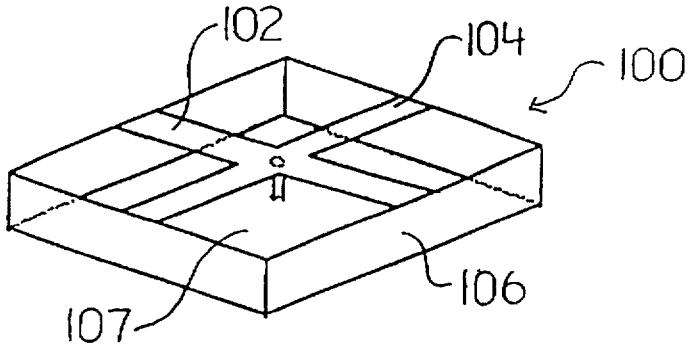
FIG. 10 is a schematic showing an embodiment installed in a conductive box according to an aspect of the invention.

The antenna may also be built into a conductive box 100 as shown in FIG. 10, in which the box 100 is formed from a peripheral wall 106 depending from antenna elements 102 and 104 and a bottom surface 107 spaced from the antenna elements 102 and 104 and enclosed by the peripheral wall 106. The antenna elements 102 and 104 of FIG. 10 are commensurate in size with the ground plane 107. Preferably, the ground plane 107 does not extend any further outward than the antenna elements 102 and 104 as shown in FIG. 10.

Figure 11:
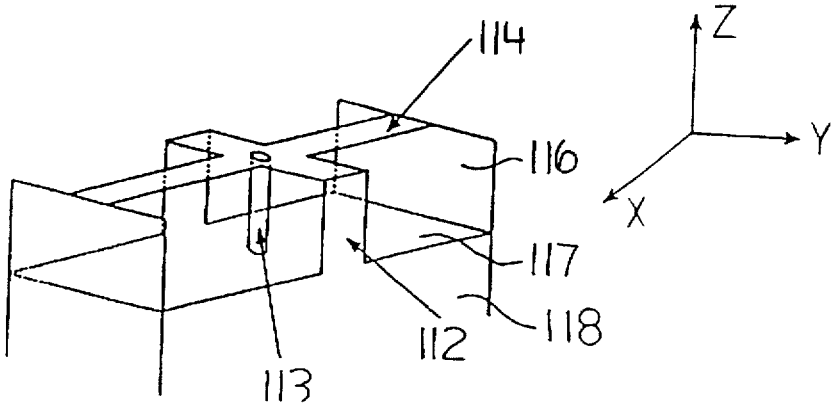
FIG. 11 is a schematic showing an embodiment on top of a rectangular box structure according to an aspect of the invention.

The conductive box 100 does not need to be square in cross section but it may have other shapes (such as part of a spherical or ellipsoid shell) and may be build into the end of a rectangular box 118 as shown in FIG. 11. The box in FIG. 11 is formed from sides 116 and bottom 117 with antenna elements 112, 113 and 114.

Each antenna element must accept electrical power from a transmission line or some other electrical circuit. The feed arrangement should satisfy two issues, (1) the physical and electrical symmetry of the antenna structure must be maintained to retain antenna element isolation and (2) tuning and impedance matching between the antenna elements and the feed structures minimizes the VSWR and therefore maximizes power transfer from the antenna to receiver or maximizes power transfer from the transmitter to the antenna.

Figure 12:
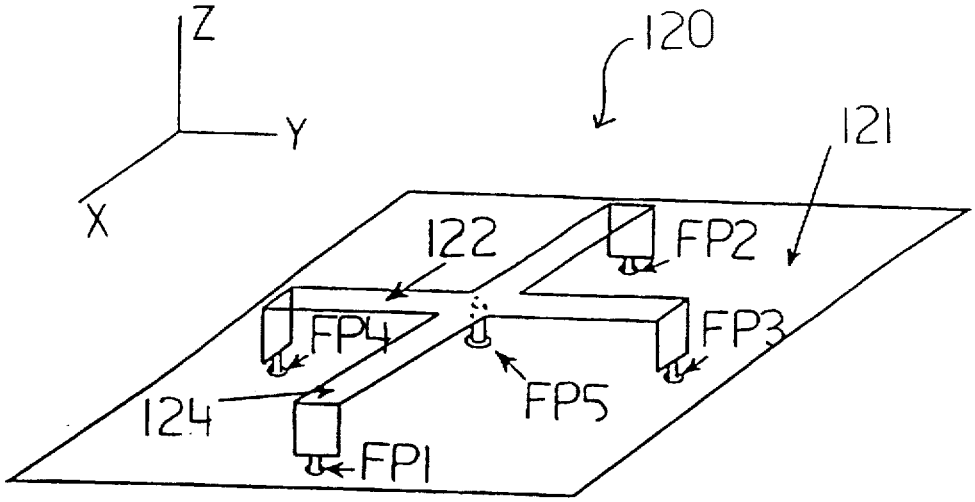
FIG. 12 is a schematic showing detail of electrical feed points according to an aspect of the invention.

The feed arrangement can best be illustrated with an antenna 120 in place on a ground plane 121 with antenna elements 122 and 124 as illustrated in FIG. 12. The Hx element 122 is driven by feed points FP3 and FP4. These feed points must be supplied with equal currents that are anti-phasal, essentially 180° out of phase. In this way the center point of the cross becomes a virtual ground, thus ensuring isolation. No voltage is conveyed to the Hy element feed point (FP1 and FP2) or to the $E_z$ element feed point (FP5).

Figure 13:
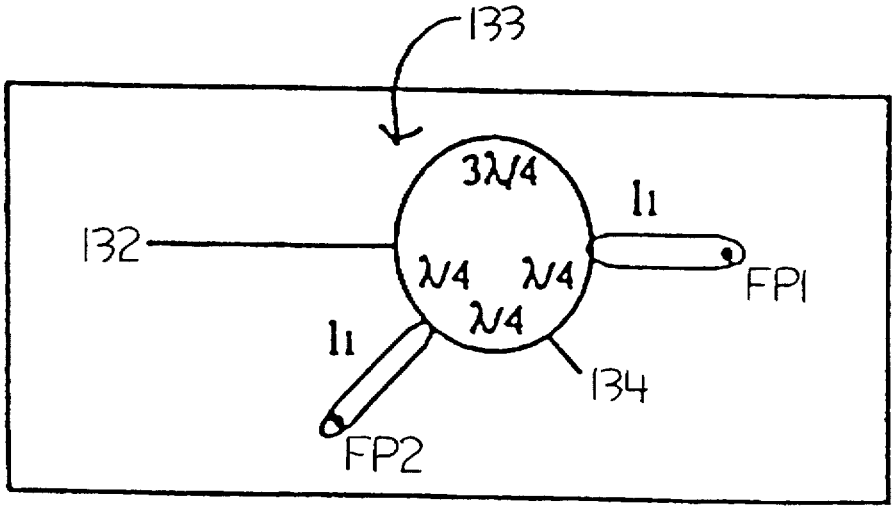
FIG. 13 is a schematic showing a signal splitter feed arrangement realized by a magic T according to an aspect of the invention.

Voltages may be delivered to feed points 1 and 2 (FP1 and FP2) with a variety of circuits that are shown in FIGS. 13 through to 15. The Hx element will have another feed circuit which would normally be identical to the Hy element feed. Transmission lines $l_1$ leading to the feed points can have a length that may be varied to maximize the bandwidth of the $E_z$ antenna element. The bandwidth of the Ez element is sensitive to the transmission line length $l_1$. The $E_z$ element achieves best bandwidth when the composite impedance looking into the feedpoints and ground plane from the loop approaches an open circuit.

In FIG. 13, a signal is input at feedpoint 132 and split by splitter 133 to feedpoints FP1 and FP2 at the end of equal length transmission lines $l_1$ in a magic T arrangement. Splitter 133 provides a 180° delay on one path ($3\lambda/4$) as compared with the other ($\lambda/4$) where $\lambda$ is the wavelength of the carrier frequency of the signals the antenna is to be used with.

Figure 14:
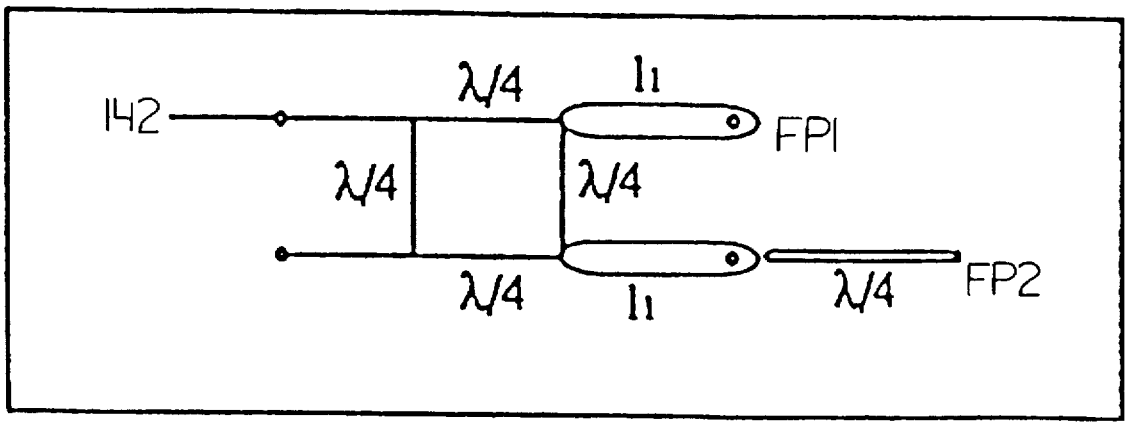
FIG. 14 is a schematic showing a signal splitter realized by a 3 dB Branch line coupler feed arrangement.

In FIG. 14, a 3 dB branch line coupler splitter arrangement is shown with signal input from a source at 142 delayed by $\lambda/4$ on the input to FP1 and delayed $3\lambda/4$ on the input to FP2.

Figure 15:
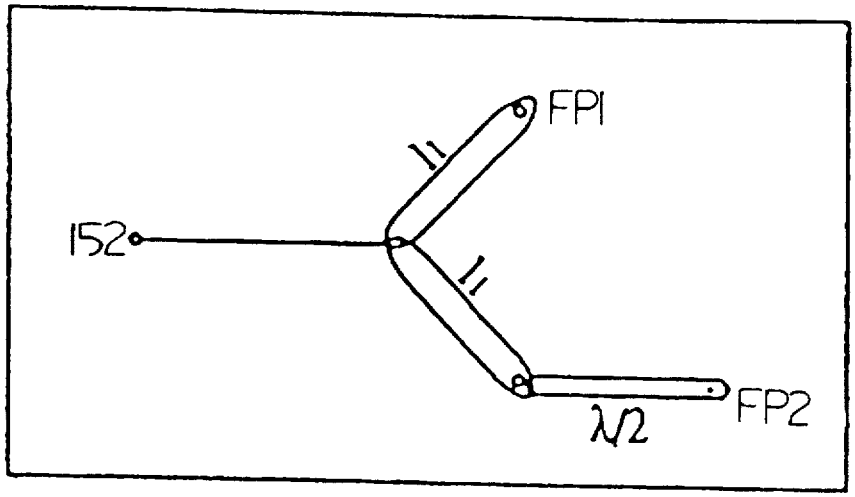
FIG. 15 is a schematic showing 3 dB Splitter Feed arrangement according to an aspect of the invention.

In FIG. 15, a 3 dB splitter feed arrangement is shown with input feedpoint 152, transmission lines $l_1$ leading to FP1 and FP2, with a delay line with $\lambda/2$ delay on the line leading to FP2.

The $E_z$ element may be fed by a single transmission line or single feed circuit without a splitter or its equivalent but it requires impedance matching. The complete antenna then has three input or output ports.

Figure 16:
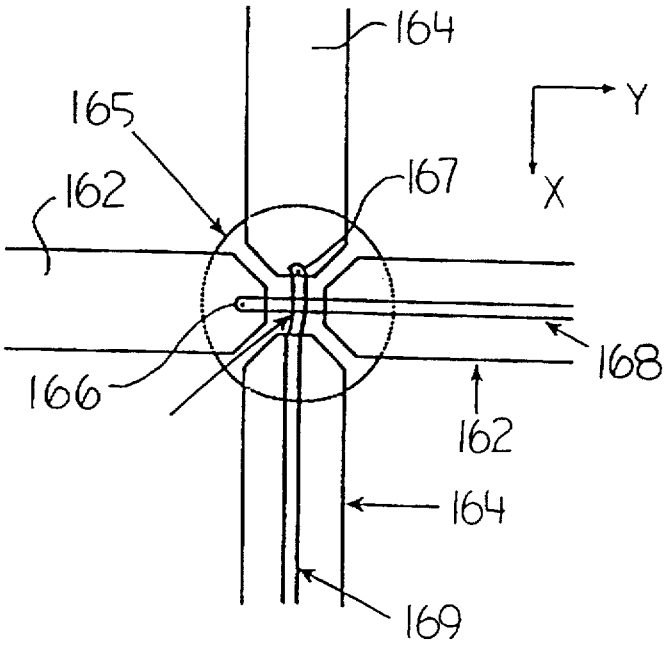
FIG. 16 is a schematic showing a feed arrangement using a microstrip line feed according to an aspect of the invention.

Another feed arrangement essentially applies the signal to the center of each magnetic loop (i.e. at the intersection of the Hx element and Hy element). Such an arrangement is shown in FIG. 16 using a microstrip line feed arrangement.

In this case, the antenna elements 164 and 162 are each formed of a pair of conducting strips, each being wider than they are deep (depth being measured perpendicular to the plane of the figure), and are used as microstrip line ground planes to produce a balun action that applies a balanced signal to the intersection 165 of the antenna elements 162 and 164. This feed arrangement eliminates the need for signal splitters shown in FIGS. 13 to 15. Conducting microstrip lines 168 and 169 extend respectively along antenna elements 162 and 164 and are spaced from them by a small gap, which is preferably filled or partly filled with insulating material. Microstrip 168 connects to the antenna element 162 at feed point 166 at the intersection generally labelled 165. Microstrip 169 bridges microstrip 168 and connects to antenna element 164 at feedpoint 167. The antenna elements 162 and 164 may be spaced from and capacitatively coupled to a monopole (for example of the type shown as element 13 in FIG. 1) at the intersection 165 (the dotted line shows roughly the boundary of the monopole). The inputs to the antenna elements 162 and 164 may be applied to the two microstrip lines 168 and 169.

Figure 28:
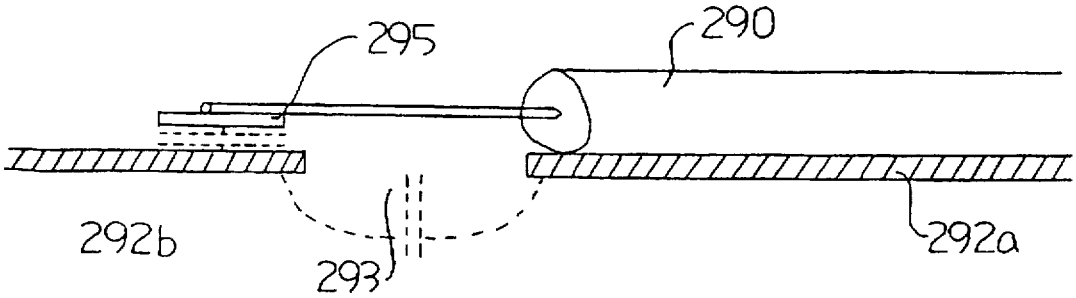
FIG. 28 shows a coaxial feed arrangement for an antenna element according to an aspect of the invention.

Other transmission line types may be substituted for the microstrip lines. Coaxial transmission lines as well as other types of transmission line may be appropriate for particular applications. A coaxial transmission line 290 is shown in FIG. 28 overlying one portion **292*a* of a strip antenna element to which the outer conductor of the coaxial transmission line is continuously connected. In this case, the antenna element 292*a* is separated from the other portion 292*b* by gap 293, similar to the gap between the portions of antenna elements 162 and 164 shown in FIG. 16. An inner conductor 294 extends from the coaxial transmission line 290 and is capacitatively coupled to portion 292*b* of the antenna element by pad 295** spaced from the antenna element.

In this embodiment the $E_z$ element has very small bandwidth even after the very low radiation resistance is matched. Thus the three way diversity antenna is no longer viable but the two magnetic loop antenna elements have very good bandwidth, are very compact and have very simple construction. This antenna makes a very good two way diversity antenna.

Figure 17:
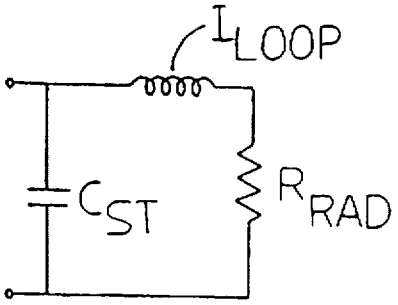
FIG. 17 is a schematic showing an equivalent circuit of the magnetic loop elemental antennas according to an aspect of the invention.

The electrical equivalent circuit of each of the loop antennas according to the invention is shown in FIG. 17, where in the antenna elements each behaves essentially as a radiation resistance $R_{rad}$ and a series inductance $L_{loop}$. In most cases a parallel capacitance $C_{st}$ also arises. The values of the radiation resistance varies with the square of the area enclosed by the loop and inversely with the wavelength to the fourth power. The inductance varies approximately as the length of loop multiplied by the natural log of the loop length over the conductor periphery. The capacitance may be regarded as a stray capacitance that occurs due to the equivalent parallel capacitance across the feed points.

Normally in a compact loop antenna the inductive reactance is large compared with radiation resistance and this effect limits the usable bandwidth of the antenna. This problem becomes more severe as the antenna is made smaller with respect to a wavelength. The loop antenna is a relatively broadband antenna compared with an electric dipole or patch antenna. K. Siwiak, "Radiowave Propagation and Antennas for Personal Communications", pp. 228–245, Artech House, 1995.

In some cases, where the loop is made large and/or the bridging capacitance is large, the impedance of the loop will become capacitative and in that case the tuning and matching circuit will require at least one inductive reactance per matching port.

In the case of reception of signals, output signals from the antenna appear at the feedpoints and are conditioned in like manner to input signals.

To connect the antenna impedance (admittance) to a practical impedance as seen by the transmitter or receiver, a tuning and matching circuit is required. Separate tuning and matching circuits can be used or a single circuit that performs both functions is often most desirable. The tuning circuit normally causes a resonance of the antenna at the desired operating frequency and the matching circuit transforms the remaining input impedance to an impedance that matches feed transmission lines and/or transmitter and/or receiver. Often the desired output impedance of the antenna is 50Ω.

The antenna tuning and matching may be done at the loop feed points as in FP1, FP2, FP3, FP4, and FP5 of FIG. 12 or at feed points of FIGS. 13, 14 and 15 for example. More tuning and matching circuits are required for the former case but better performance in terms of bandwidth and lower feed structure losses is achievable. For best electrical performance the match should be performed at or in the loop or at the junction of the loop and the feed points.

Figure 18:
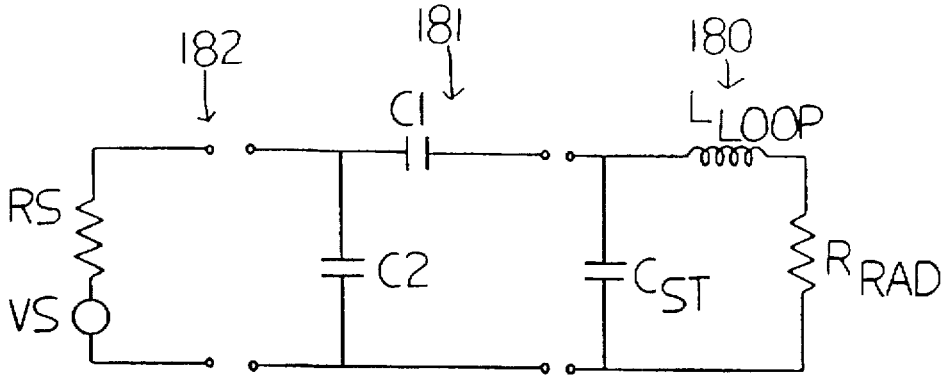
FIG. 18 is a schematic showing a capacitive matching circuit for the magnetic loop elemental antennas according to an aspect of the invention.
Figure 19:
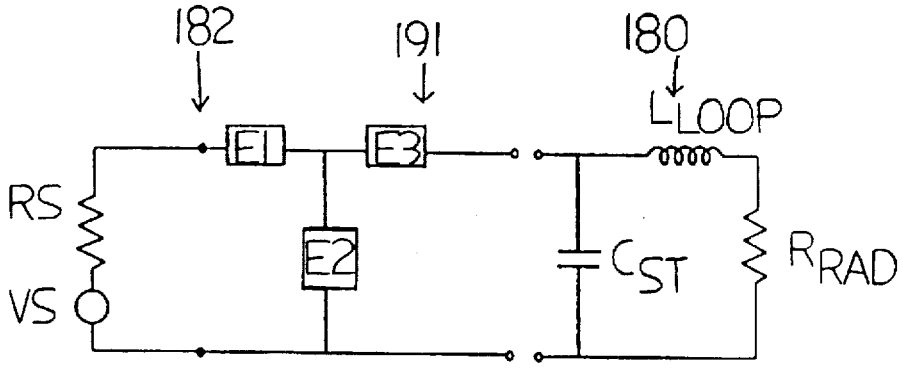
FIG. 19 is a schematic showing a T matching circuit according to an aspect of the invention.
Figure 20:
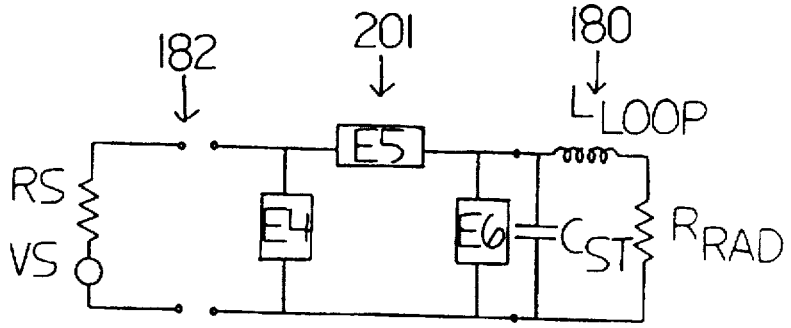
FIG. 20 is a schematic showing a $\pi$ matching circuit according to an aspect of the invention.

L, T and π matching circuits can all be used effectively to match the loop radiators. Of the three choices the L match is preferable due to its inherent wider bandwidth and simplicity of construction. The single equivalent circuit 180 of the antenna is shown in FIGS. 18, 19 and 20, formed of a capacitance $C_{st}$, an inductance $L_{loop}$ and a resistance $R_{rad}$. The source 182 driving the antenna is illustrated as a resistance RS and a voltage VS.

The most effective simple circuit to match this to 50Ω or some other standard resistance value is shown in FIG. 18 in which a capacitance C1 is formed in series between the antenna 180 and source 182, and a capacitance C2 is formed parallel with antenna 180 and source 182 to form a tuning circuit 181. In cases where loop radiators present capacitative reactances at least one inductor should be used for matching and tuning.

Examples of other circuits that may be used are shown in FIG. 19, using elements E1, E2 and E3 to form a tuning and matching circuit 191, and in FIG. 20, using elements E4, E5 and E6 to form a tuning and matching circuit 201. In the circuits 191 and 201, at least one of the elements E1, E2, E3, E4, E5 and E6 in each circuit will normally provide a capacitive reactance, while the other two can be inductive. Lossy elements in the matching circuits substantially increase loss of power to (or from) the antenna. The circuit of FIG. 19 becomes the same as the circuit in FIG. 18 if E1 has zero reactance and E2 and E3 are capacitances. The circuit of FIG. 20 becomes the same as FIG. 18 if E6 has zero reactance and E4 and E5 are capacitances.

Figure 21:
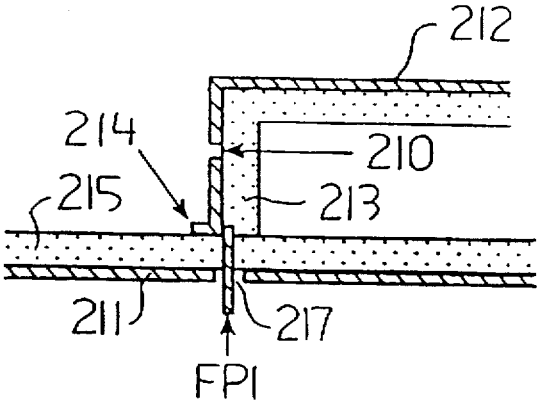
FIG. 21 is a schematic showing a matching and tuning circuit integrated with the loop antenna according to an aspect of the invention.

An example of a method of realizing the capacitances C1 and C2 integral with an antenna constructed with printed circuit board material is shown in FIG. 21, for feed points FP1 through FP4 of FIG. 12. C1 is created by capacitative gap 210 in antenna element 210. Dielectric 213 holds the antenna element 212 together. C2 is created by a capacitative gap between foot 214 of antenna element 212 and ground plane 211. Foot 214 is spaced from ground plane 211 by dielectric 215. FP1 feeds signals to the antenna element 212 through gap 217 in ground plane 211.

Figure 22:
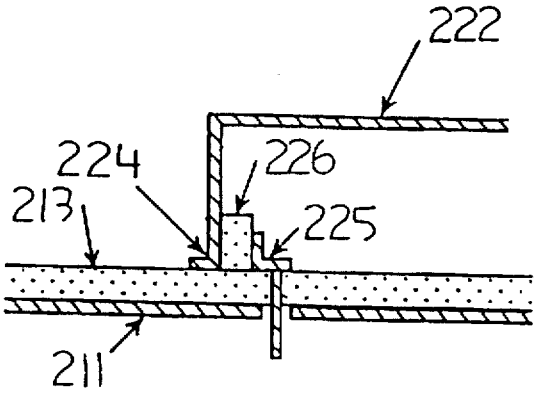
FIG. 22 is a schematic showing a detail of individual H-Element electrical feed point according to an aspect of the invention.

Alternatively the capacitors of the T match and tuning circuit 191 where E3 has zero reactance and E1 and E2 are capacitances are shown in FIG. 22. Antenna element 222 terminates in a foot 224 spaced from ground plane 221 by dielectric 213 to produce capacitance E2. Foot 224 is spaced from feed element 225 by dielectric 226 to produce capacitance E1. In the special cases where the loop presents a resistance and a capacitance the tuning and matching circuit must use at least one inductive tuning element per matching and tuning circuit. Inductive tuning elements may be connected across the capacitative gaps 214 and 210 in FIG. 21 and 224 and 226 in FIG. 22 to perform the proper tuning and matching.

Figure 29A:
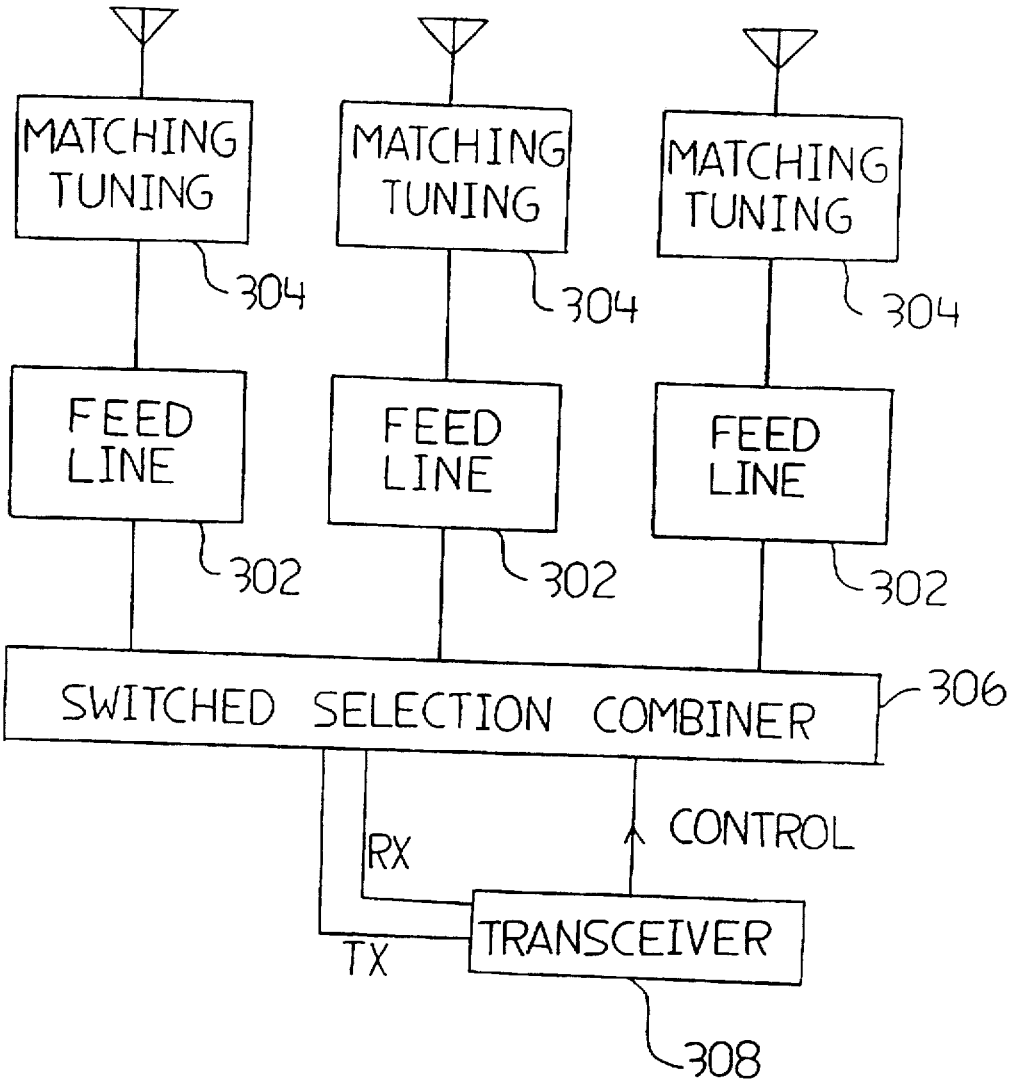
FIG. 29*a* is a schematic showing basic components of a first embodiment of a radio transceiver according to the invention.
Figure 29B:
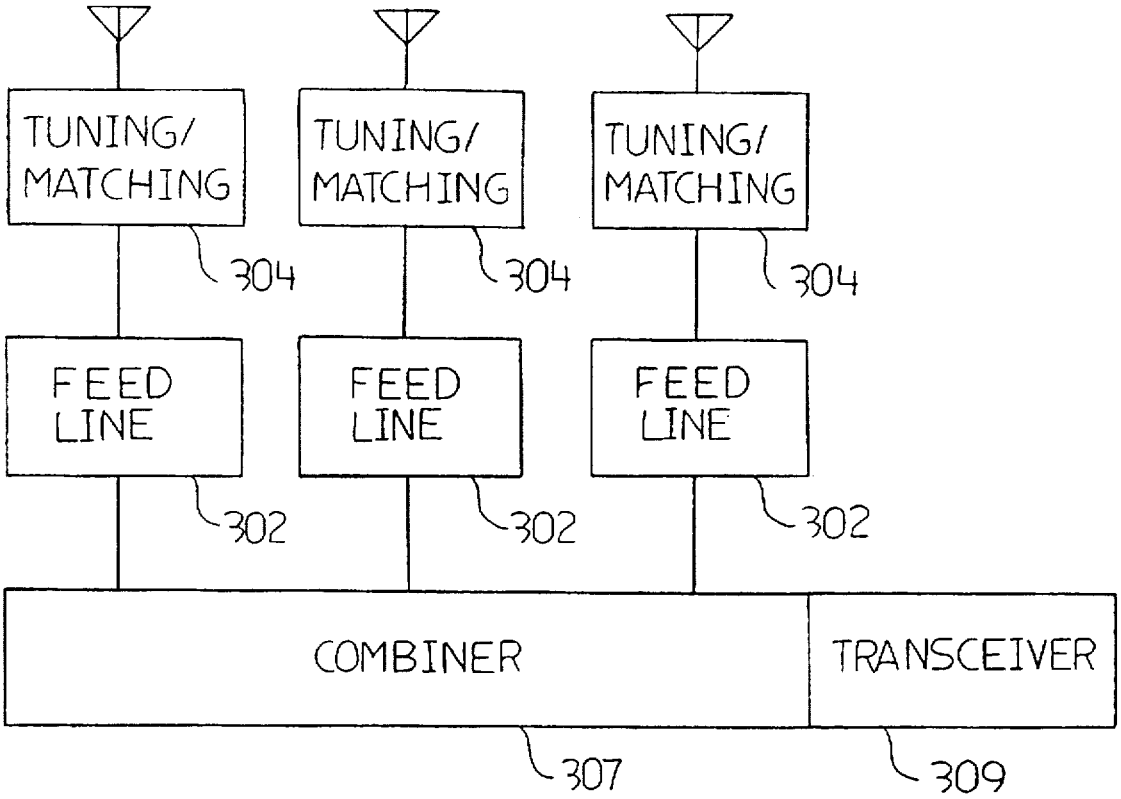
FIG. 29*b* is a schematic showing basic components of a second embodiment of a radio transceiver according to the invention.

Generally, a mobile radio transceiver with an antenna may have the overall configuration shown in FIGS. 29*a* or 29*b*. Antennas 300 (corresponding to the three antenna elements) are connected to radio transceivers 308 or 309 respectively through feed circuit 302, tuning and matching circuit 304 and combiner 306 or 307 respectively. The feed circuits 302 and tuning and matching circuits 304 are preferably as shown in FIGS. 13–15 and 18–20 respectively. Combiner 306 is a conventional switched selection combiner, altered in accordance with the specifications of the antenna 300, feed circuit 302 and tuning and matching circuit 304. Combiner 307 is an equal gain, maximal ratio or other similar combiner. Transceivers 308 or 309 are conventional mobile radio transceivers or cellular phones.

Figure 30:
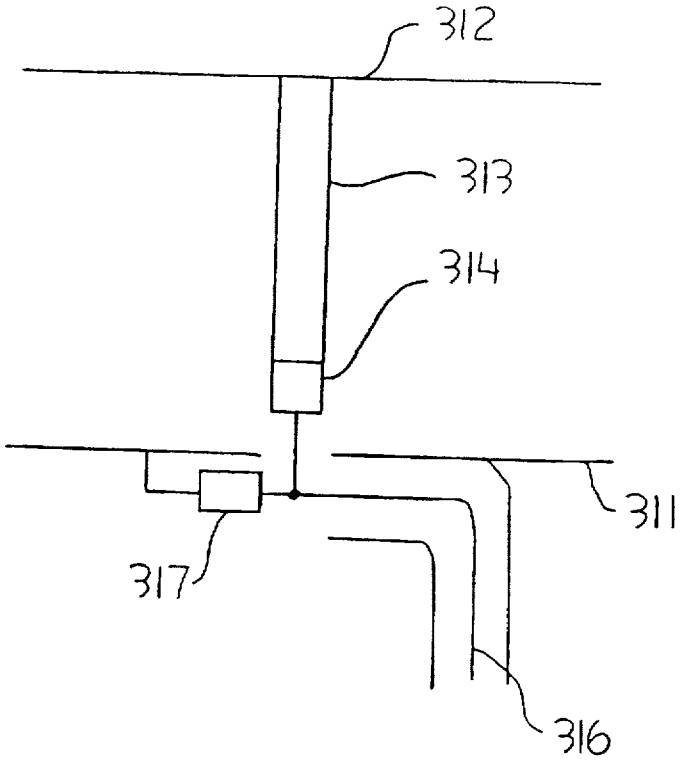
FIG. 30 is a schematic showing a feed for a monopole antenna element for use in the invention.

FIG. 30 shows a matching arrangement for a monopole antenna element 313 at the intersection of crossed loops 312. The monopole 313 is connected via a series reactance to a feed line 316, which is in turn connected to the ground plane 311 via a short reactance 317.

Measurements and numerical antenna analysis (MININEC) show that magnetic loop antennas on a small square ground plane produce weak magnetic and electric fields on the back side of the ground planes compared with the front side of the antenna. The electric monopole antenna produces a weak field on the back side of the ground plane providing that the ground plane is slightly larger (i.e. 0.015λ or so) than the electric monopole structures. The loops ($H_x$ and $H_y$ elements) produce both a near magnetic field and a near electric field. The near electric field on the back side (ground plane side) shielding effects are as much as 35 dB down from the corresponding point of the front side of the antenna. The near magnetic field is as much as 10 dB down on the back side compared with the corresponding front side location. The average suppression of the near E field on the back is about 25 dB and the average suppression of the H field on the back is about 6 dB. The electric monopole produces similar results when a ground plane is extended about 0.015λ beyond the monopole radiating structure. These results were obtained for a ground plane with dimensions of 0.22λ by 0.22λ with full length loops with a height of about 0.06λ and the point of consideration for measurement is either 0.03λ above the antenna or 0.03λ below the antenna.

The sunken ground plane structures of FIGS. 8 and 9, and the open ended box ground structure of FIG. 10, are the most effective for reducing the back near electric and magnetic fields. These features should make the antenna quite desirable where it is important to shield an operator (or the operator's head) from electromagnetic radiation.

Figure 23:
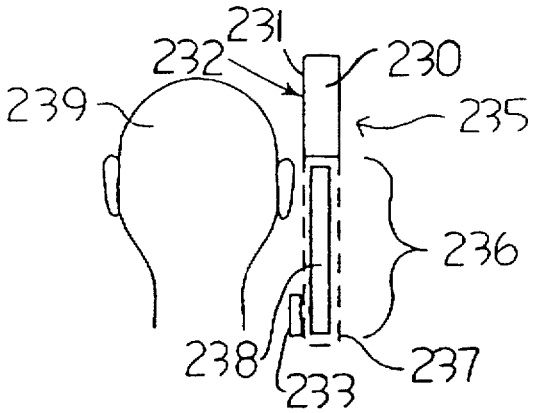
FIG. 23 is a schematic showing the relationship of the human head, antenna and cellular phone according to an aspect of the invention.

See FIG. 23 for the relationship of the antenna, the human head and the balance of the cell phone. Cell phone 236 includes a housing 237 and a radio transceiver 238, with a microphone 233 on one side of the radio transceiver 238. Antenna 230 may be slidable over the housing 237 and transceiver 238 and in use is preferably oriented in space so that the back side 232 of the ground plane 231 is adjacent to the head 239 while the front side 235 of the antenna points directly away from the head. The antenna 230 is thus oriented with respect to the housing 238 such that when the microphone 233 is in position close to the mouth of a mobile phone user the first side 232 of the antenna 230 is closer to the head 239 of the user than the second side 235 of the antenna 230.

This antenna invention provides for flexible antenna design where:

(1) Bandwidth and antenna compactness may be traded for each other. Higher bandwidths will require a larger antenna. Small antennas will have reduced bandwidth. Bandwidths of 1 to 20% of the operating frequency are practical design goals.

(2) The antenna may have many different embodiments. There are numerous ground plane relationships and there are a number of distinct feed arrangements, that still allows for different tuning and matching circuits as well as different plan views and different side view embodiments. The various practical and effective embodiments make the antenna very adaptable and therefore suitable for many applications.

(3) T. Auberey and P. White, "A comparison of switched pattern diversity antennas", Proc. 43rd IEEE Vehicular Technology Conference, pp. 89–92, 1993, has identified the sin ϕ, cos ϕ and omni as a near optimal group of radiation patterns in a vertically polarized multipath environment. The three way diversity embodiment of this antenna provides the above and also provides for reception and transmission of horizontally polarized waves in a multipath environment.

(4) The antenna elements, when properly fed, are highly isolated from each other. Each antenna is unaffected, impedance wise, radiation pattern wise, power output wise by whatever signal is fed into any one of the other antenna elements, or by whatever impedance that terminates any of the other antenna elements.

(5) The center fed cross magnetic loop antenna elements provide a two way diversity antenna that has good bandwidth and very simple construction.

(6) The available ground plane embodiments provide for substantial shielding of the operator's head from near electric and magnetic fields. These ground planes are compact and do not add significantly to the antenna structure. The shielding will help reduce health and legal concerns and will provide more power to the communications channel.

Figure 24:
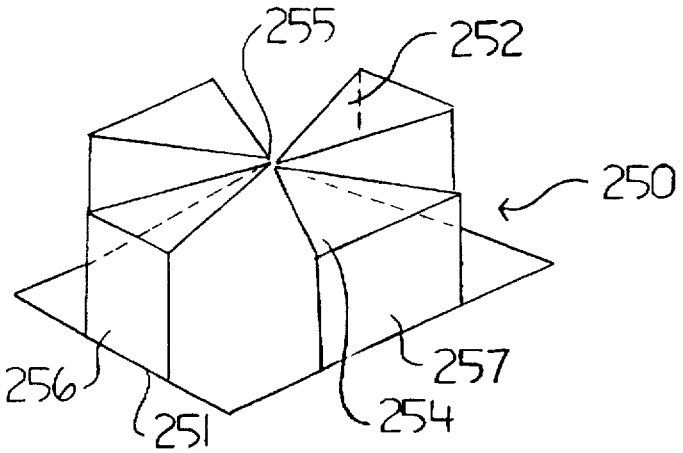
FIG. 24 shows a pie shaped antenna configuration according to an aspect of the invention.
Figure 25:
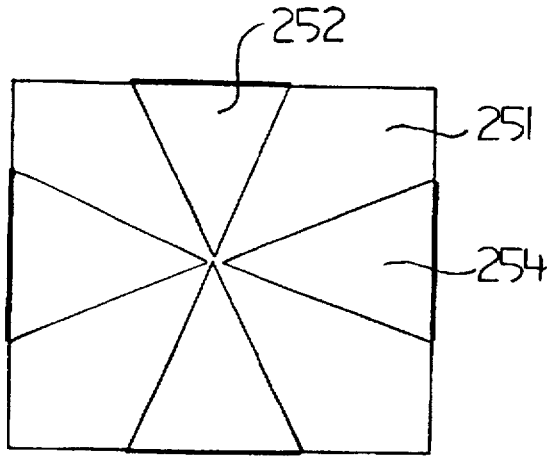
FIG. 25 shows a top view of the embodiment of FIG. 24.

As shown in FIGS. 24 and 25, an antenna 250 may be formed of antenna elements 252 and 254 formed of pie shaped sections tapering towards the intersection 255 of the antenna elements, with vertical straps 256 and 257 extending between the antenna elements 252 and 254 and the ground plane 251 respectively.

Figure 26:
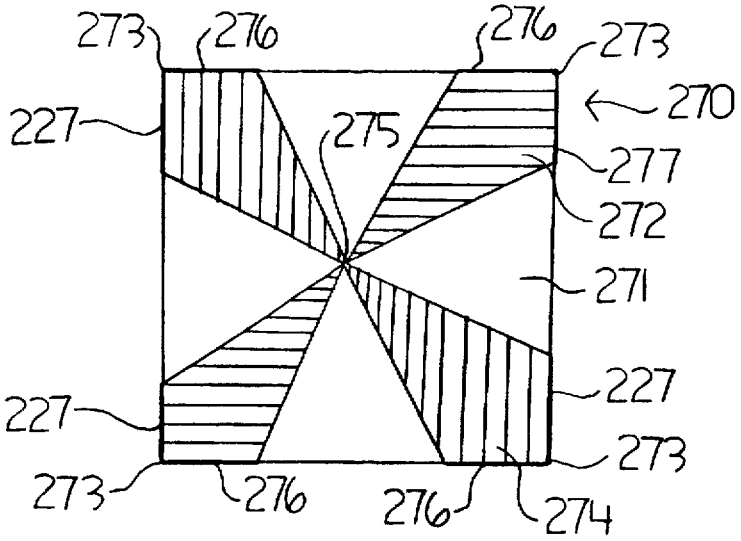
FIG. 26 shows a top view of a pie shaped antenna configuration with diagonalized antenna loops.

As shown in FIG. 26, antenna 270 may have pie shaped antenna elements 272, 274 extending diagonally between opposed corners 273 of the square ground plane 271. The antenna elements 272, 274 intersect at 275, and are connected physically to the ground plane 271 by vertical straps 276 and 277. The pie shaped sections should not occupy the entire area above the ground plane 271, since otherwise the radiation may be blocked. The angle of the pie shaped sections may be about 45°.

Figure 27:
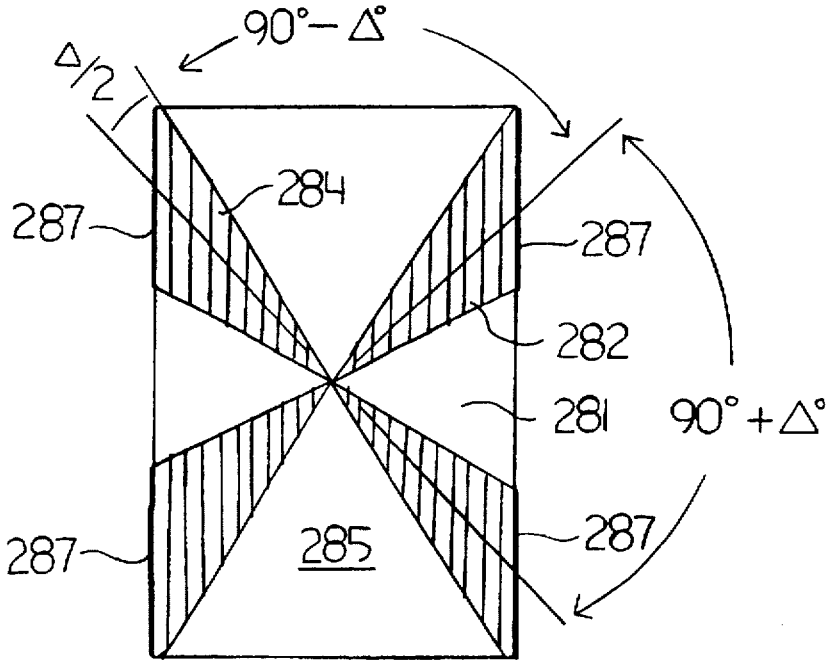
FIG. 27 shows an embodiment of an antenna with diagonalized pie shaped antenna elements for sliding over a radio transceiver, such as shown in FIG. 23.

A further embodiment of an antenna 280 is shown in FIG. 27 designed for sliding over a cellular phone housing or transceiver. Pie shaped antenna elements 282 and 284 extend diagonally across a rectangular ground plane 281. Each antenna element 282, 284 is connected physically to the ground plane by vertical straps 287. The angle Δ must be chosen to minimize coupling between the two antenna elements 282 and 284. The antenna elements 282, 284 are spaced from the ground plane 281 to form an inside cavity 285 into which the radio transceiver 238 of FIG. 23 may be slid when the radio transceiver is not in use.

A person skilled in the art could make immaterial modifications to the invention described in this patent document without departing from the essence of the invention that is intended to be covered by the scope of the claims that follow.

The embodiments of the invention in which an exclusive property or privilege is claimed are defined as follows:

1. An antenna for use in a radio system, wherein the radio system operates at an operating frequency, the antenna comprising:

means forming a ground plane;

a first antenna element extending in a loop from a first part of the ground plane to a second part of the ground plane;

a second antenna element extending in a loop from a third part of the ground plane to a fourth part of the ground plane, the second antenna element intersecting the first antenna element at an intersection;

a third antenna element forming a conducting reactively top loaded monopole intersecting the first and second antenna elements at the intersection of the first and second antenna elements;

feed means to feed electric signals to the first and second antenna elements; and the feed means being configured to supply the first and second antenna elements with currents that are essentially 180° out of phase, and thereby to produce a virtual ground at the intersection of the first and second antenna elements, whereby the first, second and third antenna elements are electrically isolated from each other at the operating frequency.

2. The antenna of claim 1 in which each antenna element is formed of strips whose width is greater than their thickness.

3. The antenna of claim 1 in which the first and second antenna elements bisect each other.

4. The antenna of claim 1 in which the ground plane is commensurate in size to the first and second antenna elements.

5. The antenna of claim 1 in which each of the first and second antenna elements is curved.

6. The antenna of claim 5 in which each of the first and second antenna elements form part of a spherical shell.

7. The antenna of claim 1 in which the ground plane extends laterally no further than the first and second antenna elements.

8. The antenna of claim 1 in which the ground plane forms a box, the box including:

a peripheral wall depending from the first and second antenna elements; and a bottom spaced from the first and second antenna elements and enclosed by the peripheral wall.

9. The antenna of claim 8 in which the box is rectangular.

10. The antenna of claim 9 in which the first and second antenna elements extend between diagonal corners of the box.

11. The antenna of claim 1 in which the first and second antenna elements are orthogonal to each other.

12. The antenna of claim 1 in which at least each of the first, second and third antenna elements create a reactance in use and further including:

means integral with each of the first, second and third antenna elements for tuning out the reactance of the respective first, second and third antenna elements.

13. The antenna of claim 12 in which each means for tuning out the reactance of the first, second and third antenna elements includes a capacitative element matching the respective one of the first, second and third antenna elements to a given impedance.

14. The antenna of claim 1 in which the ground plane has a length, in its longest dimension, of less than the wavelength of the carrier frequency with which the antenna is to be used.

15. An antenna for use in a radio system, wherein the radio system operates at an operating frequency, the antenna comprising:

means forming a ground plane;

a first antenna element extending in a loop from a first part of the ground plane to a second part of the ground plane;

a second antenna element extending in a loop from a third part of the ground plane to a fourth part of the ground plane, the second antenna element intersecting the first antenna element at an intersection;

feed means to feed electric signals to the first and second antenna elements at the intersection of the first and second antenna elements; and feed means being configured to supply the first and second antenna elements with currents that are essentially 180° out of phase, and thereby to produce a virtual ground at the intersection of the first and second antenna elements, whereby the first and second antenna elements are electrically isolated from each other at the operating frequency.

16. The antenna of claim 15 in which each antenna element is formed of pie shaped sections tapering towards the intersection of the first and second antenna elements.

17. The antenna of claim 15 in which the first and second antenna elements bisect each other.

18. The antenna of claim 15 in which the ground plane is commensurate in size to the first and second antenna elements.

19. The antenna of claim 15 in which each antenna element is formed of strips whose width is greater than their thickness.

20. The antenna of claim 19 in which the feed means for each antenna element forms a transmission line connected to the respective antenna elements at the intersection of the antenna elements.

21. The antenna of claim 20 in which the feed means includes, for each antenna element:

a conducting microstrip capacitatively coupled to the antenna element.

22. The antenna of claim 21 in which:

the first and second antenna elements are each formed of first and second conducting strips spaced from each at the intersection of the first and second antenna elements; and the conducting microstrip of each antenna element connects to one of the first and second conducting strips and extends along and spaced from the other of the first and second conducting strips.

23. The antenna of claim 21 in which the feed means for each antenna element is a coaxial transmission line continuously connected to a portion of the antenna element.

24. The antenna of claim 15 in which the first and second antenna elements are orthogonal to each other.

25. The antenna of claim 15 in which the feed means includes:

a first feed point on the first antenna element;

a second feed point on the second antenna element;

a source of electrical energy; and a splitter connected to the source of electrical energy and to the first and second feed points to provide equal anti-phasal currents to the respective first and second feed points.

26. The antenna of claim 15 in which each of the first and second antenna elements creates a reactance in use and further including:

means integral with each of the first and second antenna elements for tuning out the reactance of the respective first and second antenna elements.

27. The antenna of claim 26 in which each means for tuning out the reactance of the first and second antenna elements includes means matching the respective one of the first and second antenna elements to a given impedance.

28. The antenna of claim 15 in which the ground plane has a length, in its longest dimension, of less than the wavelength of the carrier frequency with which the antenna is to be used.

29. An antenna for use in a radio system, wherein the radio system operates at an operating frequency, the antenna comprising:

means forming a ground plane;

a first antenna element extending in a loop from a first part of the ground plane to a second part of the ground plane;

a second antenna element extending in a loop from a third part of the ground plane to a fourth part of the ground plane, the second antenna element intersecting the first antenna element at an intersection;

feed means to feed electric signals to the first and second antenna elements;

the feed means being configured to supply the first and second antenna elements with currents that are essentially 180° out of phase, and thereby to produce a virtual ground at the intersection of the first and second antenna elements, whereby the first and second antenna elements are electrically isolated from each other at the operating frequency; and the ground plane forming a box, the box including a peripheral wall depending from the first and second antenna elements and a bottom spaced from the first and second antenna elements and enclosed by the peripheral wall.

30. The antenna of claim 29 in which the box is rectangular.

31. The antenna of claim 29 in which each antenna element is formed of a strip whose width is greater than its depth.

32. The antenna of claim 31 in which:

the feed means for each antenna element is connected to the respective antenna elements at the intersection of the first and second antenna elements; and the feed means for each antenna element forms a transmission line.

33. The antenna of claim 32 in which the feed means includes, for each antenna element:

a conducting microstrip capacitatively coupled to the antenna element.

34. The antenna of claim 33 in which:

the first and second antenna elements are each formed of first and second conducting strips spaced from each other at the intersection of the first and second antenna elements; and the conducting microstrip of each antenna element connects to one of the first and second conducting strips and extends along and spaced from the other of the first and second conducting strips.

35. The antenna of claim 32 in which the feed means for each antenna element is a coaxial transmission line continuously connected to a portion of the antenna element.

36. The antenna of claim 29 in which each antenna element is formed of pie shaped sections tapering towards the intersection of the first and second antenna elements.

37. The antenna of claim 29 in which the first and second antenna elements bisect each other.

38. The antenna of claim 29 in which the ground plane is commensurate in size to the first and second antenna elements.

39. The antenna of claim 29 in which the ground plane extends laterally no further than the first and second antenna elements.

40. The antenna of claim 29 in which the first and second antenna elements are orthogonal to each other.

41. The antenna of claim 29 in which each of the first and second antenna elements creates a reactance in use and further including:

means integral with each of the first and second antenna elements for tuning out the reactance of the respective first and second antenna elements.

42. The antenna of claim 41 in which each means for tuning out the reactance of the first and second antenna elements includes means matching the respective one of the first and second antenna elements to a given impedance.

43. The antenna of claim 29 in which the ground plane has a length, in its longest dimension, of less than the wavelength of the carrier frequency with which the antenna is to be used.

44. A mobile phone transceiver for use in a radio system, wherein the radio system operates at an operating frequency, the mobile phone transceiver comprising:

a housing;

a radio transceiver disposed within the housing, the radiotransceiver including a microphone on one side of the housing;

an antenna having means forming a ground plane with a weak near field on a first side of the antenna, and antenna elements on a second side of the antenna, the ground plane forming a ground for the antenna elements, the antenna being oriented with respect to the housing such that when the microphone is in position close to the mouth of a mobile phone user the first side of the antenna is closer to the head of the user than the second side of the antenna;

the antenna further comprising:

a first antenna element extending in a loop from a first part of the ground plane to a second part of the ground plane;

a second antenna element extending in a loop from a third part of the ground plane to a fourth part of the ground plane, the second antenna element intersecting the first antenna element at an intersection;

feed means to feed electric signals to the first and second antenna elements; and the feed means being configured to supply the first and second antenna elements with currents that are essentially 180° out of phase, and thereby to produce a virtual ground at the intersection of the first and second antenna elements, whereby the first and second antenna elements are electrically isolated from each other at the operating frequency.

45. The mobile phone transceiver of claim 44 further including:

a third antenna element forming a conducting reactively top loaded monopole intersecting the first and second antenna elements at the intersection of the first and second antenna elements.

46. The mobile phone transceiver of claim 44 in which the first and second antenna elements are orthogonal to each other.

47. The mobile phone transceiver of claim 44 further including a diversity combiner connected to the radio transceiver and to the antenna.

48. The mobile phone transceiver of claim 44 in which the ground plane forms a box, the box including a peripheral wall depending from the first and second antenna elements and a bottom spaced from the first and second antenna elements and enclosed by the peripheral wall.

49. The mobile phone transceiver of claim 48 in which the box is rectangular.

50. The mobile phone transceiver of claim 44 in which each antenna element forms a strip having a width greater than its depth.

51. The mobile phone transceiver of claim 50 in which the feed means for each antenna element is connected to the respective antenna elements at the intersection of the first and second antenna elements.

52. The mobile phone transceiver of claim 51 in which the feed means for each antenna element forms a transmission line.

53. The mobile phone transceiver of claim 52 in which the feed means includes, for each antenna element:

a conducting microstrip capacitatively coupled to the antenna element.

54. The mobile phone transceiver of claim 53 in which:

the first and second antenna elements are each formed of first and second conducting strips spaced from each at the intersection of the first and second antenna elements; and the conducting microstrip of each antenna element connects to one of the first and second conducting strips and extends along and spaced from the other of the first and second conducting strips.

55. The mobile phone transceiver of claim 52 in which the feed means for each antenna element is a coaxial transmission line including an outer conductor that is continuously connected to a portion of the antenna element.

56. The mobile phone transceiver of claim 44 in which each antenna element is formed of pie shaped sections tapering towards the intersection of the first and second antenna elements.

57. The mobile phone transceiver of claim 44 in which the antenna is slidable over the radio transceiver.

58. The mobile phone transceiver of claim 57 in which the first and second antenna elements are spaced from the ground plane to form a cavity for receiving the radio transceiver.

59. The mobile phone transceiver of claim 58 in which each antenna element is formed of pie shaped sections tapering towards the intersection of the first and second antenna elements, each pie shape section terminating in a vertical conductors, the vertical conductors of each of the antenna elements being spaced apart to receive the radio transceiver between them.

60. The mobile phone transceiver of claim 44 in which the first and second antenna elements bisect each other.

61. The mobile phone transceiver of claim 44 in which the ground plane is commensurate in size to the antenna.

62. The mobile phone transceiver of claim 44 in which the antenna includes antenna elements and the ground plane extends laterally no further than the antenna elements.

63. The mobile phone transceiver of claim 44 in which each of the first and second antenna elements creates a reactance in use and further including:

means integral with each of the first and second antenna elements for tuning out the reactance of the respective first and second antenna elements.

64. The mobile phone transceiver of claim 63 in which each means for tuning out the reactance of the first and second antenna elements includes means matching the respective one of the first and second antenna elements to a given impedance.

65. The mobile phone transceiver of claim 44 in which the ground plane has a length, in its longest dimension, of less than the wavelength of the carrier frequency with which the antenna is to be used.

* * * * *